United States Patent [19]

Kawata et al.

[11] Patent Number: 4,636,462

[45] Date of Patent: Jan. 13, 1987

[54] HEAT-DEVELOPABLE PHOTOSENSITIVE MATERIAL

[75] Inventors: Ken Kawata; Yoshiharu Yabuki; Kozo Sato; Hiroyuki Hirai, all of Kanagawa, Japan

[73] Assignee: Fuji Photo Film Co., Ltd., Kanagawa, Japan

[21] Appl. No.: 769,288

[22] Filed: Aug. 26, 1985

[30] Foreign Application Priority Data

Aug. 24, 1984 [JP] Japan ..... 59-176402

[51] Int. Cl.[4] ..... G03C 1/02

[52] U.S. Cl. ..... 430/617; 430/619; 430/620; 430/955; 430/171; 430/151; 430/203; 430/353; 430/964; 430/338

[58] Field of Search ..... 430/617, 619, 203, 955, 430/151, 179, 171, 620, 353, 964, 338, 374

[56] References Cited

U.S. PATENT DOCUMENTS

| | | | |
|---|---|---|---|
| 3,220,846 | 11/1965 | Tinker et al. | 430/346 |
| 4,499,172 | 2/1985 | Hirai et al. | 430/203 |
| 4,514,493 | 4/1985 | Hirai et al. | 430/203 |

FOREIGN PATENT DOCUMENTS

| | | | |
|---|---|---|---|
| 909491 | 10/1962 | United Kingdom | 430/151 |
| 0084890 | 8/1983 | European Pat. Off. . | |

*Primary Examiner*—Won H. Louie

*Attorney, Agent, or Firm*—Sughrue, Mion, Zinn, Macpeak & Seas

[57] ABSTRACT

A heat-developable photosensitive material which contains a compound of the general formula:

(I)

(II)

wherein F and F' each represents an atomic group necessary for the formation of a 5- or 6-membered rings which may have condensed rings; n represents an integer of 0 or 1; $R^1$ and $R^2$ which may be the same or different, each represents a hydrogen atom, a halogen atom, a hydroxyl group, a cyano group, or a substituted or unsubstituted alkyl group, cycloalkyl group, alkenyl group, alkynyl group, aryl group, heterocyclic residual group, aralkyl group, alkoxy group, aryloxy group, acylamino group, acyloxy group, acyl group, carbamoyl group, sulfamoyl group, sulfamoylamino group, ureido group, alkylsulfonyl group, arylsulfonyl group, alkylsulfonylamino group, arylsulfonylamino group, alkoxycarbonyl group or alkoxycarbonylamino group, or $-CO_2M$; and $R^1$ and $R^2$ may be combine and form a ring, M is an alkali metal or H.Bx in which B represents an organic base; and x represents an integer of 1 when B is a monoacidic base and represents $\frac{1}{2}$ when B is a diacidic base.

9 Claims, No Drawings

HEAT-DEVELOPABLE PHOTOSENSITIVE MATERIAL

FIELD OF THE INVENTION

This invention relates to a heat-developable photosensitive material containing a base precursor.

BACKGROUND OF THE INVENTION

Generally heat-developable photosensitive materials contain a base or a base precursor to promote development upon heating. More preferably from the standpoint of shelf stability of the photosensitive material a base precursor which liberates basic substances upon thermal decomposition is used.

Examples of typical base precursors are described in British Pat. No. 998,949.

In this connection, preferred base precursors are salts of carboxylic acids and organic bases. Useful carboxylic acids include trichloroacetic acid, and trifluoroacetic acid. Useful bases include guanidine, piperidine, morpholine, p-toluidine, and 2-picoline.

An especially useful carboxylic acid is guanidine-trichloroacetic acid, which is described in U.S. Pat. No. 3,220,846. Japanese Patent Application (OPI) No. 22625/75 describes aldonamides, which decompose at a high temperature to form a base and therefore these may be advantageously used.

However, most of these prior art base precursors take a relatively long period of time to provide images or suffer occurrence of fog. Furthermore, these base precursors are disadvantageous in that they are influenced by air or moisture which causes decomposition that leads to a deterioration of the photographic properties of the photosensitive material or a substantial degradation of shelf stability thereof.

SUMMARY OF THE INVENTION

It is therefore an object of the present invention to provide a heat-developable photosensitive material containing a base precursor with an excellent shelf stability which is capable of providing a high density image in a short period of time.

The above object is achieved by the present invention which is described hereinafter.

Specifically, the present invention provides a heat-developable photosensitive material which contains a compound of the general formula (I) or (II):

(I)

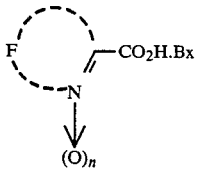

(II)

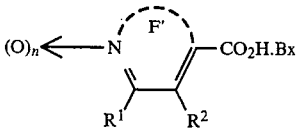

wherein F and F' each represents an atomic group necessary for the formation of a 5- or 6-membered ring optionally having a condensed ring; n represents an integer of 0 or 1; and $R^1$ and $R^2$, which may be the same or different each represents a hydrogen atom, a halogen atom, a hydroxyl group, a cyano group, or a substituted or unsubstituted alkyl group, cycloalkyl group, alkenyl group, alkynyl group, aryl group, heterocyclic group, aralkyl group, alkoxy group, aryloxy group, acylamino group, acyloxy group, acyl group, carbamoyl group, sulfamoyl group, sulfamoylamino group, ureido group, alkylsulfonyl group, arylsulfonyl group, alkylsulfonylamino group, arylsulfonylamino group, alkoxycarbonyl group or alkoxycarbonylamino group, $—CO_2H.3$ wherein B is as defined hereinafter or $—CO_2M$ in which M represents an alkali metal or $H.B_x$ (wherein B and x are as hereinafter defined), and wherein $R^1$ and $R^2$ may combine and form a ring, B represents an organic group, and x represents an integer of 1 when B is a monoacidic base and represents ½ when B is a diacidic base.

DETAILED DESCRIPTION OF THE INVENTION

The present invention will be further illustrated in detail.

The heat-developable photosensitive material of the present invention contains as a base precursor a compound of the following general formula (I) or (II):

(I)

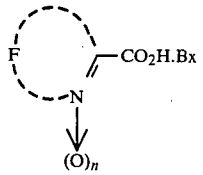

(II)

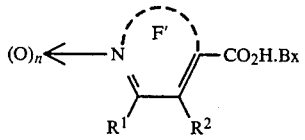

In the general formulas (I) and (II), F and F' each represents an atomic group necessary for the formation of a 5- or 6-membered ring, and n represents an integer of 0 or 1.

F and F' each represents a divalent residual group having an arrangement capable of forming the above ring comprising at least one or a combination of carbon, nitrogen, oxygen and sulfur.

Specifically, if F and F' represents a 6-membered ring, F is a divalent residual group comprising four atoms and F' represents a divalent residual group comprising two atoms. In the case of a 5-membered ring, F is a divalent residual group comprising three atoms and F' is a divalent residual group comprising one atom.

In this case, especially when two carbon atoms or carbon atoms and a nitrogen atom are adjacent to each other, they may form a double bond or substituents bonded to each atom may be linked to each other.

As a substituent bonded to the nitrogen atom a substituted or unsubstituted $C_{1-10}$ alkyl group (e.g., methyl, ethyl, etc.) or a substituted or unsubstituted $C_{6-10}$ aryl group (e.g., phenyl, tolyl, etc.) is preferred.

As a substituent bonded to a carbon atom, substituents the same as $R^1$ and $R^2$ in the general formula (II) described hereinafter are suitable.

An aromatic ring such as benzene ring may be condensed to the 5- or 6-membered ring comprising F or F'.

$R^1$ and $R^2$ each is a hydrogen atom, a halogen atom (e.g., chlorine, bromine, etc.), a hydroxyl group, a cyano group, a substituted or unsubstituted $C_{1-10}$ alkyl group (preferably $C_{1-5}$ alkyl, e.g., methyl, ethyl, etc.), a substituted or unsubstituted $C_{5-8}$ cycloalkyl group (e.g., cyclohexyl, etc.), a substituted or unsubstituted $C_{2-5}$ alkenyl group (e.g., allyl, etc.), a substituted or unsubstituted $C_{2-5}$ alkynyl group (e.g., acetylenyl, etc.), a substituted or unsubstituted $C_{6-18}$ aryl group (preferably $C_{6-10}$ aryl, e.g., phenyl, chlorophenyl, tolyl, etc.), a substituted or unsubstituted 5- or 6-membered heterocyclic group, which may be condensed (e.g., benzimidazole, benzothiazole, pyridine, pyrazine, pyrimidine, triazine, pyrazole, etc.), a substituted or unsubstituted $C_{7-15}$ aralkyl group (preferably $C_{7-10}$ aralkyl, e.g., benzyl, phenethyl, etc.), or a substituted or unsubstituted alkoxy group preferably having 1 to 10 carbon atoms (e.g., methoxy, ethoxy, etc.), a substituted or unsubstituted aryloxy group preferably having 6 to 10 carbon atoms (e.g., phenoxy, etc.), a substituted or unsubstituted acylamino group preferably having 1 to 10 carbon atoms (e.g., acetylamino, etc.), a substituted or unsubstituted acyloxy group preferably having 1 to 10 carbon atoms (e.g., acetyloxy, etc.), a substituted or unsubstituted acyl group preferably having 1 to 10 carbon atoms (e.g., acetyl, etc.), a substituted or unsubstituted carbamoyl group preferably having 1 to 10 carbon atoms (e.g., dimethylcarbamoyl, etc.), a substituted or unsubstituted sulfamoyl group preferably having 1 to 10 carbon atoms (e.g., dimethylsulfamoyl, etc.), a substituted or unsubstituted ureido group preferably having 1 to 10 carbon atoms (e.g., methylureido, etc.), a substituted or unsubstituted sulfamoylamino group preferably having 1 to 10 carbon atoms (e.g., dimethylsulfamoylamino, etc.), a substituted or unsubstituted alkylsulfonyl group preferably having 1 to 10 carbon atoms (e.g., methylsulfonyl, etc.), a substituted or unsubstituted arylsulfonyl group preferably having 6 to 10 carbon atoms (e.g., phenylsulfonyl, etc.), a substituted or unsubstituted alkylsulfonylamino group preferably having 1 to 10 carbon atoms (e.g., methylsulfonylamino, etc.), a substituted or unsubstituted arylsulfonylamino group preferably having 6 to 10 carbon atoms (e.g., phenylsulfonylamino, etc.), or a substituted or unsubstituted alkoxycarbonylamino group preferably having 2 to 10 carbon atoms (e.g., ethoxycarbonylamino, etc.), $—CO_2H.B$ (where B is later defined), or $—CO_2M$ (where M is an alkali metal e.g., Li, Na, K, etc.).

$R^1$ and $R^2$ may be bonded to each other to form a substituted or unsubstituted benzene or cyclohexane ring or the like.

Specifically, $R^1$ and $R^2$ preferably is a hydrogen atom or condensed benzene rings bonded to each other.

Preferred examples of the 5-membered ring comprising F in the general formula (I) are benzimidazole and benzothiazole. Preferred examples of the 6-membered rings comprising F include pyridine, pyrazine, pyrimidine, and triazine.

Preferred examples of the 5- or 6-membered ring comprising F′ in the general formula (II) are pyrazole and pyridine.

B represents an organic base. B is preferably an organic base having a pKa of 9 or more and a boiling point of about 100° C. or more, more preferably an organic base having a pKa of 10 or more and being substantially non-volatile at ordinary temperature and free of an offensive odor. Such organic bases include guanidines, cyclic guanidines such as

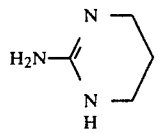

amidines, and cyclic amidines such as

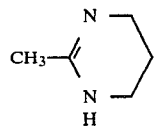

Furthermore, B preferably is hydrophilic. B preferably is an organic base having 10 or less carbon atoms. Preferred examples of B are shown below:

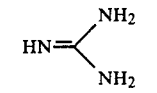

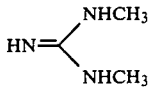

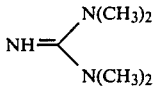

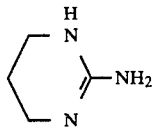

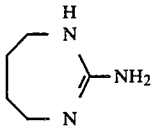

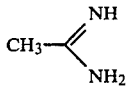

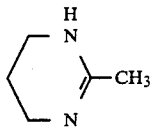

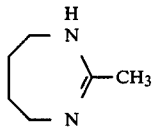

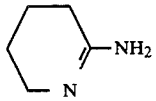

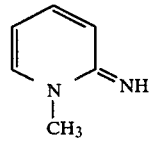

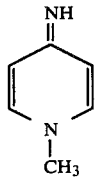

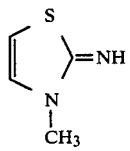

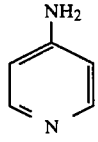

-continued
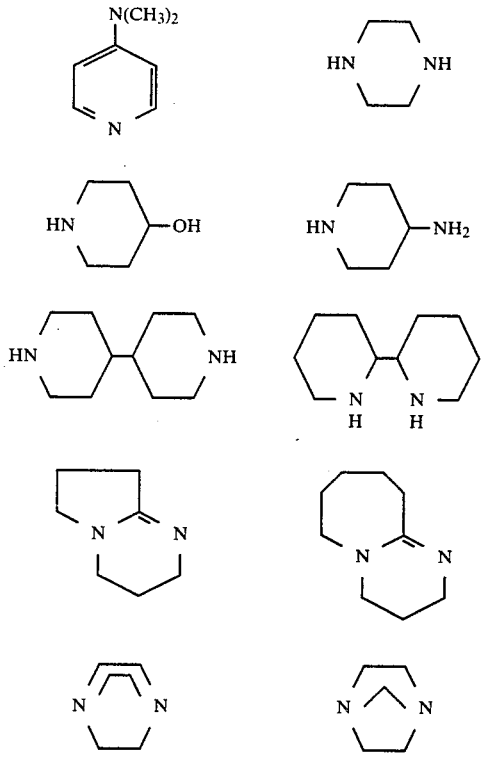
Of these, the following are more preferred.
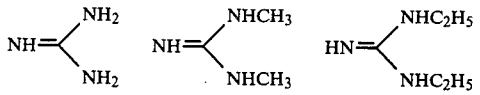
x represents an integer of 1 when B is a monoacidic base and ½ when B is a diacidic base.
Examples of base precursors preferably used in the present invention are shown below:
(1)
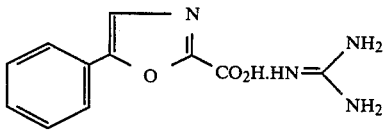
(2)
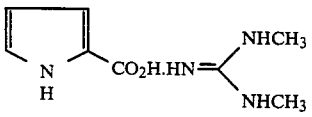
(3)
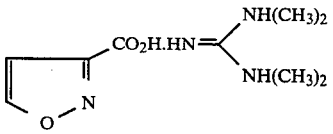
(4)
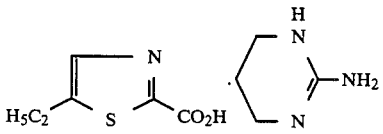
-continued
(5)
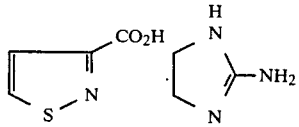
(6)
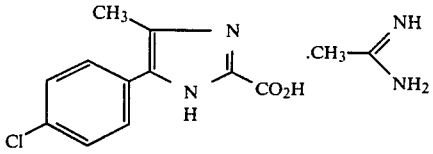
(7)
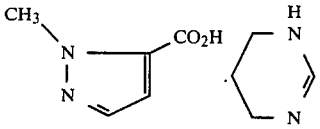
(8)
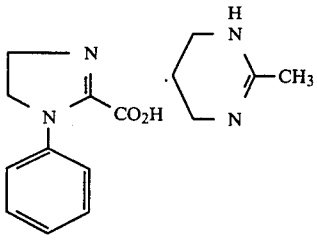
(9)
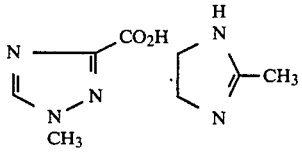
(10)
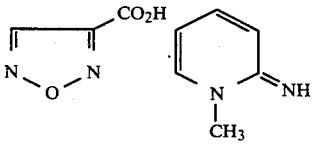
(11)
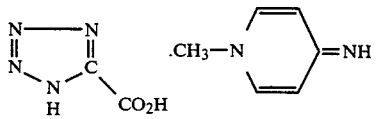
(12)
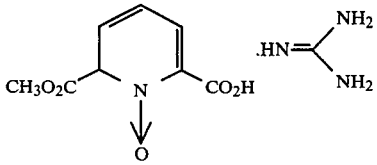
(13)
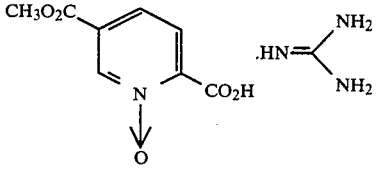

-continued (14)

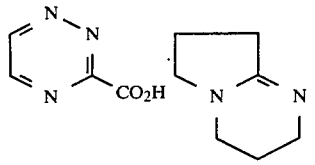

(15)

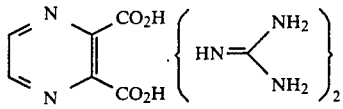

(16)

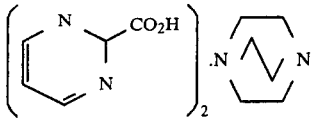

(17)

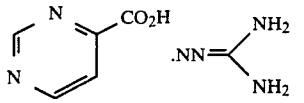

(18)

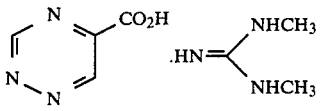

(19)

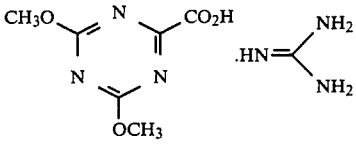

(20)

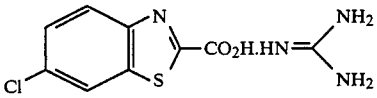

(21)

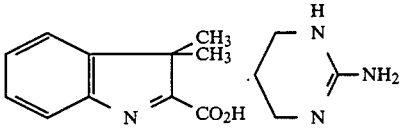

(22)

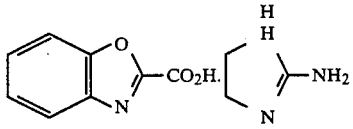

(23)

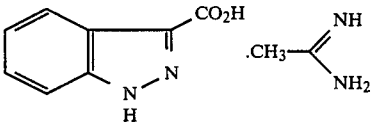

(24)

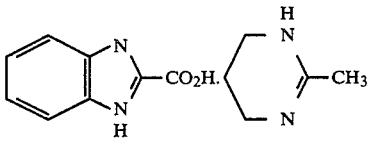

(25)

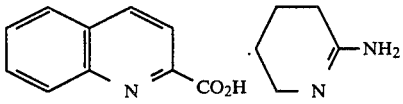

-continued (26)

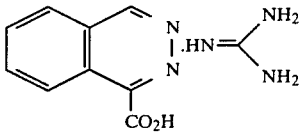

(27)

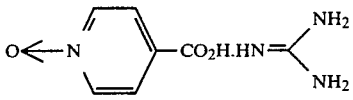

Heterocyclic carboxylic acids which can be used in the production of the base precursors employed in the present invention can generally be prepared using various processes, which are divided into three main processes: (1) a process in which a carboxyl group is introduced simultaneously with the formation of a heterocyclic ring (e.g., Chiaki Tanaka, *Yakugaku Zasshi,* 85, 186 (1965), etc.); (2) a process in which a heterocyclic compound containing a methyl group or a formyl group as a substituent is oxidized (e.g., C. R. Adams, *J. Heterocyclic Chemistry,* 4, 137 (1967), etc.); and (3) a process in which a carboxyl group is directly introduced into a heterocyclic compound (e.g., H. Gilman, J. A. Beel, *Journal of American Chemical Society,* 71, 2328 (1949), etc.). The heterocyclic carboxylic acids can be converted into corresponding salts according to conventional salt formation reaction to obtain the base precursors which can be used in the present invention.

The following examples are given to illustrate the synthesis of base precursors used in the present invention:

Unless otherwise indicated herein, all parts, percents, ratios and the like are by weight.

SYNTHESIS EXAMPLE 1

Synthesis of Base Precursor (1)

10.0 g of ω-aminoacetophenone hydrochloride and 9.4 g of ethoxalyl chloride were added to 20 ml of anhydrous benzene. The admixture was heated on a water bath. As a result, the contents were gradually dissolved in the anhydrous benzene, with the evolution of hydrogen chloride. After 5 hours, the benzene was distilled off, and the residue was then recrystallized from water to obtain 10.5 g of ethoxalylaminoacetonephenone. m.p. 96°–97° C.

5.0 g of the ethoxyalylaminoacetonephenone thus obtained was added to 10 ml of anhydrous benzene. 10 g of phosphorus oxychloride was added to the admixture under cooling with ice. The admixture was then gradually heated on a water bath for reaction. After the reaction was completed, the benzene and excess phosphoryl chloride were distilled off under reduced pressure, and the residue was then treated with ice water and extracted with benzene.

The residue was then washed with water and allowed to dry. The solvent was distilled off from the residue. The residue was recrystallized from water-ethanol to obtain 3.2 g of ethyl 5-phenyloxazole-2-carboxylate. m.p. 60°–61° C.

1.0 g of the ethyl 5-phenyloxazole-2-carboxylate thus obtained was dissolved in 10 ml of a water-ethanol solution of 0.3 g of sodium hydroxide. The solution was heated on a water bath for 30 minutes. The ethanol was distilled off, and the residue was then treated with activated carbon. The residue thus treated was acidified with hydrochloric acid under cooling to obtain 0.65 g of white powder crystal of 5-phenyloxazole-2-carboxylic acid.

m.p. 80°–82° C. (decomposition).

18.9 g of the 5-phenyloxazole-2-carboxylic acid was dissolved in 100 ml of a water-methanol (1:2) by volume solution. 8.0 g of guanidine carbonate was then gradually added to the solution to obtain crystals which were then filtered to obtain 14 g of Compound (1).

m.p. 142°–143° C. (decomposition).

SYNTHESIS EXAMPLE 2

Synthesis of Base Precursor (12)

50 g of pyridine-2,6-dicarboxylic acid was suspended in 275 g of water. 47 g of 30% hydrogen peroxide aqueous solution and 2.8 g of sodium tungstate were added to the resulting suspension. The suspension was heated to a temperature of 90° C. for 24 hours. As a result, the carboxylic acid as starting material was gradually dissolved in the aqueous solution during heating, and fresh crystals were then deposited. 24 g of 30% hydrogen peroxide aqueous solution was further added to the solution. The solution was heated for 12 hours and then allowed to cool to obtain 48 g of colorless prismatic creptais of pyridine-2,6-dicarboxylic acid N-oxide.

m.p. 156°–157° C. (decomposition).

40 g of the pyridine-2,6-dicarboxylic acid N-oxide was dissolved in 100 ml of methanol. 5 ml of sulfuric acid was added to the solution. The admixture was then heated under reflux for 2 hours and allowed, to cool so that crystals were deposited. The crystals thus deposited were filtered to obtain 28 g of 6-methoxycarbonylpyridine-2-carboxylic acid.

m.p. 125°–126° C. (decomposition).

19.7 g of the 6-methoxycarbonylpyridine-2-carboxylic acid thus obtained was dissolved in 100 ml of a water-methanol (1:3 by volume) solution. 9.0 g of guanidine carbonate was gradually added to the solution. Immediately before the addition was completed, crystals deposited. After the solution was stirred for 10 minutes, the crystals were filtered off, washed with chilled methanol, and dried to obtain 20.8 g of a compound (12).

m.p. 166°–168° C. (decomposition).

SYNTHESIS EXAMPLE 3

Synthesis of Base Precursor (15)

A mixture of 135 g of o-phenylenediamine, 344 g of glyoxal sodium hydrogen sulfite adduct and 3.5 l of water was stirred under heating for 15 minutes. After the mixture was allowed to cool to room temperature, 500 g of sodium carbonate monohydrate was added thereto.

The resulting oil was extracted with diethyl ether, and the residue was then dried.

The solvent was distilled off, and the residue was then distilled under reduced pressure to obtain 147 g of quinoxaline.

b.p. 108°–111° C./12 mmHg.

A saturated aqueous solution of 1050 g of potassium permanganate was gradually added to a mixture of 4 l of 90° C. hot water and 145 g of the quinoxaline thus obtained over 1.5 hours. The reaction solution was filtered under reduced pressure, and the residue was then washed with 1 l of water. The filtrate was heated under reduced pressure until the solution was concentrated to 3 l. 550 ml of concentrated hydrochloric acid was slowly added to the concentrated solution so that the solution was evaporated to dryness. 200 ml of water was added to the dried matter. 2 l of acetone was added to the mixture. The admixture was heated under reflux for 15 minutes, and then filtered under heating.

The filtrate was decolorized with activated carbon, and the solvent was then distilled off. The residue was recrystallized from water to obtain 130 g of pyrazine-2,3-dicarboxylic acid.

m.p. 183°–185° C.

16.8 g of the pyrazine-2,3-dicarboxylic acid was dissolved in 100 ml of a water-methanol (1:3 by volume) solution. 18.0 g of guanidine carbonate was gradually added to the solution. The resulting crystals were filtered off, and then washed with chilled methanol to obtain 30.2 g of a Compound (15).

m.p. 258°–260° C. (decomposition).

The base precursor according to the present invention is especially effective when it is employed together with a spectrally sensitized light-sensitive silver halide emulsion, and in particular the degree of increase in image density is particularly large in this case.

The spectral sensitization of silver halide emulsions can be performed using methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes and hemioxonol dyes. Of these dyes, cyanine dyes, merocyanine dyes and complex merocyanine dyes are particularly useful. Any conventionally utilized nucleus for cyanine dyes, such as a basic heterocyclic nucleus, is applicable to dyes useful in the present invention, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus. Furthermore, nuclei formed by condensing alicyclic hydrocarbon rings with these nuclei and nuclei formed by condensing aromatic hydrocarbon rings with these nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus may also be used. The carbon atoms of these nuclei may be substituted.

In merocyanine dyes and complex merocyanine dyes, nuclei having a ketomethylene structure can include 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus or a thiobarbituric acid nucleus.

These sensitizing dyes can be employed individually and can also be employed in combination thereof. A combination of sensitizing dyes is often used, particularly for the purpose of supersensitization.

Useful sensitizing dyes include those described in German Pat. No. 929,080, U.S. Pat. Nos. 2,493,748, 2,503,776, 2,519,001, 2,912,329, 3,656,959, 3,672,897, 3,694,217, 4,025,349 and 4,046,572, British Pat. No. 1,242,588, and Japanese Patent Publication Nos. 14030/69 and 24844/77.

A suitable amount of the sensitizing dye to be used is from about 0.001 g to 20 g, and preferably from about 0.01 g to 2 g, per 100 g of silver contained in the emulsion.

The amount of base precursor according to the present invention used can vary in a broad range. It is suitably used in an amount of about 50% by weight or less, and more preferably in a range from about 0.01% by weight to 40% by weight, based on the amount of a coating layer of the light-sensitive material (dry basis).

Any unit and layer structure can be applied to the light-sensitive material of the present invention. The base precursor may be incorporated into any one of various layers of the light-sensitive material. When a light-sensitive emulsion layer and a layer containing a dye providing substance are separately constructed, the base precursor may be incorporated into any of these layers. Further, it can be incorporated into an interlayer or a protective layer.

Moreover, two or more base precursors according to the present invention can be used.

In the present invention, silver halide as a light-sensitive substance is preferably employed.

The silver halide used in the present invention can be any conventional light-sensitive silver halide, including silver chloride, silver chlorobromide, silver chloroiodide, silver bromide, silver iodobromide, silver chloroiodobromide and silver iodide.

Any conventional process for preparing those silver halides can be used, such as a typical method of preparing silver iodobromide by first adding a silver nitrate solution to a potassium bromide solution to form silver bromide particles and then adding potassium iodide to the mixture.

Two or more silver halides in which the particle size and/or halogen composition are different from each other may be used in combination.

The average particle size of the silver halide used in the present invention is preferably from about 0.001 μm to 10 μm and more preferably from about 0.001 μm to 5 μm.

The silver halide used in the present invention may be unsensitized or chemically sensitized with a conventional chemical sensitizing agent such as compounds of sulfur, selenium or tellurium, or compounds of gold, platinum, palladium, rhodium or iridium, a reducing agent such as tin halide, or a combination thereof. The details of suitable sensitization methods are described in T. H. James, *The Theory of the Photographic Process,* pages 149 to 169 (4th Ed. 1977).

A suitable coating amount of the light-sensitive silver halide according to the present invention is from about 1 mg to 10 g/m$^2$ calculated as silver.

In a particularly preferred embodiment of the heat-developable light-sensitive material according to the present invention, an organic silver salt oxidizing agent is used together with silver halide. The organic silver salt oxidizing agent is a silver salt which forms a silver image by reacting with the hereinafter described reductive dye providing substance or with optional reducing agents present together with the image forming substances, when it is heated to a temperature of above about 80° C. and preferably above about 100° C. in the presence of exposed silver halide. Combined use of such an organic silver salt oxidizing agent, the light-sensitive material which provides higher color density can be obtained.

The silver halide used in conjunction with an organic silver salt oxidizing agent does not necessarily contain pure silver iodide crystal in the case of using the silver halide alone. Any silver halide which is known in the art can be used.

Examples of such organic silver salt oxidizing agents include those described in U.S. Pat. No. 4,500,626, and specifically include the following.

A silver salt of an organic compound having a carboxy group can be used, including a silver salt of an aliphatic carboxylic acid and a silver salt of an aromatic carboxylic acid.

In addition, a silver salt of a compound containing a mercapto group or a thione group or a derivative thereof can be used.

Further, a silver salt of a compound containing an imino group can be used, including a silver salt of benzotriazole and a derivative thereof described in Japanese Patent Publication No. 30270/69 and U.S. Pat. No. 3,635,719, e.g., a silver salt of benzotriazole, a silver salt of an alkyl-substituted benzotriazole such as a silver salt of methylbenzotriazole, a silver salt of a halogen-substituted benzotriazole such as a silver salt of 5-chorobenzotriazole, a silver salt of carboimidobenzotriazole such as a silver salt of butylcarboimidobenzotriazole, a silver salt of 1,2,4-triazole or 1-H-tetrazole as described in U.S. Pat. No. 4,220,709, a silver salt of carbazole, a silver salt of saccharin, a silver salt of imidazole and an imidazole derivative.

Moreover, a silver salt as described in *Research Disclosure,* Vol. 170, No. 17029 and an organic metal salt such as copper stearate can be used as organic metal salt oxidizing agents in the present invention.

Methods of preparing these silver halide and organic silver salt oxidizing agents and methods of blending them are described in *Research Disclosure,* No. 17029, Japanese Patent Application (OPI) Nos. 42529/76, 13224/74 and 17216/75 and U.S. Pat. Nos. 3,700,458 and 4,076,539.

A suitable coating amount of the light-sensitive silver halide and the organic silver salt oxidizing agent employed in the present invention is a total of from about 50 mg/m$^2$ to 10 g/m$^2$ calculated as silver.

In the present invention, a wide variety of image forming substances can be used in addition to silver as an image forming substance.

For instance, couplers capable of forming color images by bonding to oxidation products of developing agents employed in conventional liquid development processing can be used in the present invention, with specific examples including magenta couplers such as 5-pyrazolone couplers, pyrazolobenzimidazole couplers, cyanoacetylcumarone couplers and open chain acylacetonitrile couplers, yellow couplers such as acylacetamide couplers (e.g., benzoylacetanilides and pivaloylacetanilides), and cyan couplers such as naphthol couplers and phenol couplers.

It is generally desirable that these couplers should be rendered nondiffusible by a hydrophobic group (i.e., a "ballast group") in their molecules, or that the couplers should be polymeric couplers. The couplers may be either 4-equivalent or 2-equivalent with respect to silver ion. Further, these couplers may be colored couplers having a color correction effect, or couplers capable of releasing development inhibitors upon development (i.e., "DIR couplers").

In addition, dyes which can produce positive color images using light-sensitive silver dye bleach processes, for example, dyes described in *Research Disclosure,* pages 30–32, RD-14433 (April, 1976), *Research Disclosure,* pages 14–15, RD-15227 (December 1976), and U.S. Pat. No. 4,235,957, and leuco dyes described in U.S. Pat. Nos. 3,985,565 and 4,022,617, can be used.

Also, dyes into which nitrogen-containing heterocyclic groups are introduced described in *Research Disclosure,* pages 54–58, RD-16966 (May, 1978) can be used.

Moreover, dye providing substances described in European Patent Nos. 57,455 and 79,056, West German Patent No. 3,217,853, which release mobile dyes by a coupling reaction with reducing agents oxidized by a redox reaction with silver halide or organic silver salt oxidizing agents under high temperatures, and dye providing substances described in European Patent Nos. 66,282 and 76,492, West German Patent No. 3,215,485, and Japanese Patent Application (OPI) Nos. 154445/84 and 152440/84, which undergo a redox reaction with silver halide or organic silver salt oxidizing agents under high temperatures, and release mobile dyes as a result of this reaction, can be used.

Dye providing substances which can be used in the above described processes are preferably represented by the following formula (CI):

$$(\text{Dye}—X)_q—Y \qquad \text{(CI)}$$

wherein Dye represents a dye which becomes mobile when it is released from the molecule of the compound represented by the formula (CI); X represents a simple bond or a connecting group; q represents 1; and Y represents a group which releases Dye in correspondence or countercorrespondence to light-sensitive silver salts having a latent image distributed imagewise, the diffusibility of a dye released being different from that of the compound represented by $(\text{Dye}—X)_q—Y$.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes. These dyes can also be used in a color-shifted form having temporarily shorter wavelengths, the original color of which is recoverable in development processing.

More specifically, dyes described in European Patent No. 76,492 can be utilized.

Examples of the connecting group represented by X include —NR— (wherein R represents a hydrogen atom, an alkyl group, or a substituted alkyl group), $—SO_2—$, —CO—, an alkylene group, a substituted alkylene group, a phenylene group, a substituted phenylene group, a naphthylene group, a substituted naphthylene group, —O—, —SO—, or a group containing two or more of the foregoing groups in combination.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

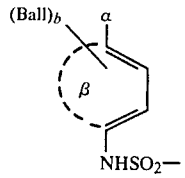

(CII)

wherein $\beta$ represents non-metallic atoms necessary for forming a benzene ring, which may optionally be condensed with a carbon ring or a hetero ring to form, for example, a naphthalene ring, a quinoline ring, a 5,6,7,8-tetrahydronaphthalene ring, a chroman ring or the like;

$\alpha$ represents a group of $—OG^{11}$ or $—NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

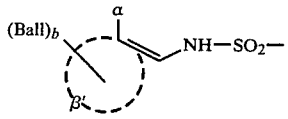

(CIII)

wherein Ball, $\alpha$ and b are the same as defined with (CII), $\beta$ represents atoms necessary for forming a carbon ring (e.g., a benzene ring which may be condensed with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16131/81, 16130/81, 4043/82 and 650/82 and U.S. Pat. No. 4,053,312.

Further examples of Y suited for this type of compound are those represented by the following formula (CIV):

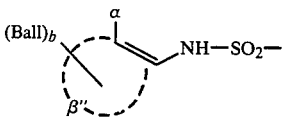

(CIV)

wherein Ball, $\alpha$ and b are the same as defined with the formula (CII), and $\beta$ represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

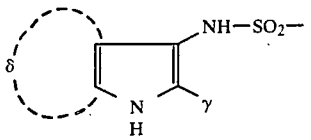

(CV)

wherein $\gamma$ preferably represents hydrogen, a substituted or unsubstituted alkyl, aryl or heterocyclic group, or —CO—$G^{21}$; $G^{21}$ represents —$OG^{22}$, —$SG^{22}$ or

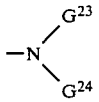

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a condensed benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

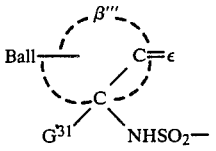

(CVI)

wherein Ball is the same as defined with the formula (CII); $\epsilon$ represents an oxygen atom or $=NG^{32}$ (wherein $G^{32}$ represents hydroxyl or an optionally substituted amino group) (examples of $H_2N$-$G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

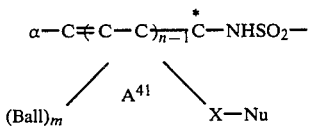

(CVII)

wherein $\alpha$ represents $OR^{41}$ or $NHR^{42}$; $R^{41}$ represents hydrogen or a hydrolyzable components; $R^{42}$ represents hydrogen, an alkyl group containing 1 to 50 carbon atoms or a hydrolyzable group; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above described formula (CII). Specific examples of this type of Y are described in Japanese Patent Application (OPI) No. 20735/82.

As still further type of examples represented by the formula (CI), there are dye providing non-diffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

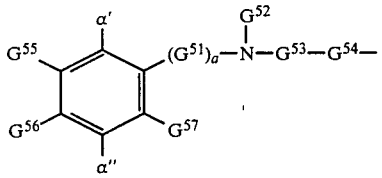

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

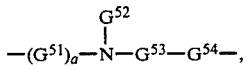

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

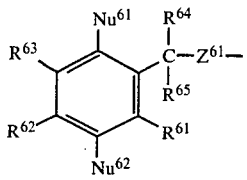

(CIX)

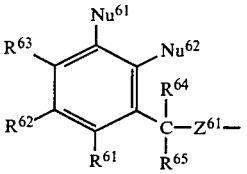

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a condensed ring together with the rest of the molecule, or $R^{62}$ and $R^{63}$ may form a condensed ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

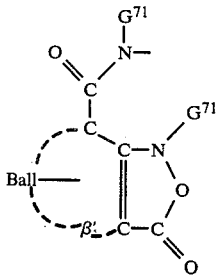

(CXI)

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

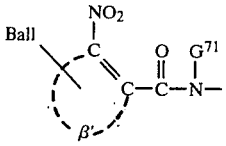

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

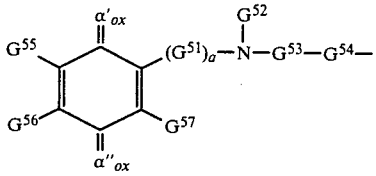

(CXIII)

wherein $\alpha'_{ox}$ nad $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIV-A) and (CXIV-B):

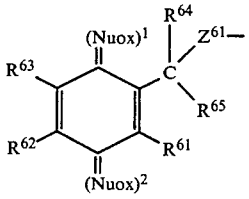

(CXIV-A)

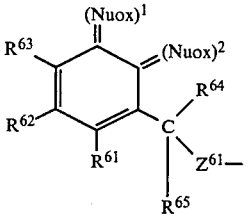

(CXIV-B)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula (CXV) (specific examples thereof being described in Japanese Patent Application (OPI) No. 60289/83):

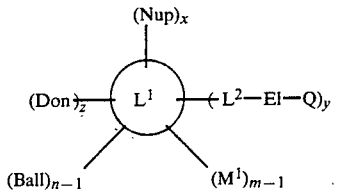

(CXV)

wherein n, x, y and z each represents 1 or 2, m represents an integer of 1 or more; Don represents a group containing an electron donor or its precursor moiety; $L^1$ represents an organic group linking Nup to —El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance non-diffusible, and is preferably a group containing a $C_{8-32}$ hydrophobic group. Such organic ballast group is bound to the dye providing substance directly or through a linking group (e.g., an imino bond, an ether bond, a thioether bond, a carbonamido group, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of dye image forming substances which can be used in the present invention are described in the patents cited hereinbefore. Since length prevents illustrating all preferred examples thereof, only a portion thereof is described hereinafter. Specific examples of the dye providing substances represented by general formula (CI) are set forth below.

CI-1

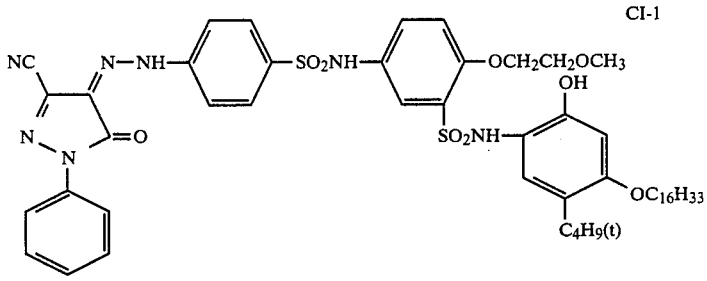

CI-2

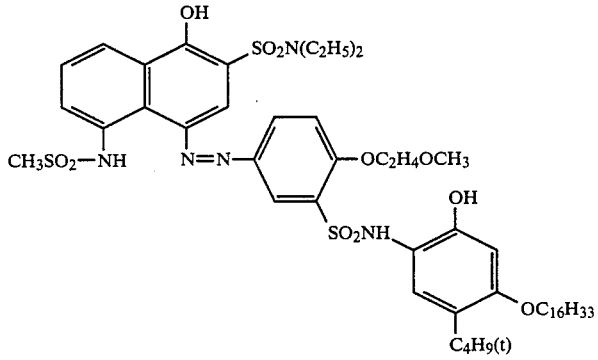

-continued
CI-3
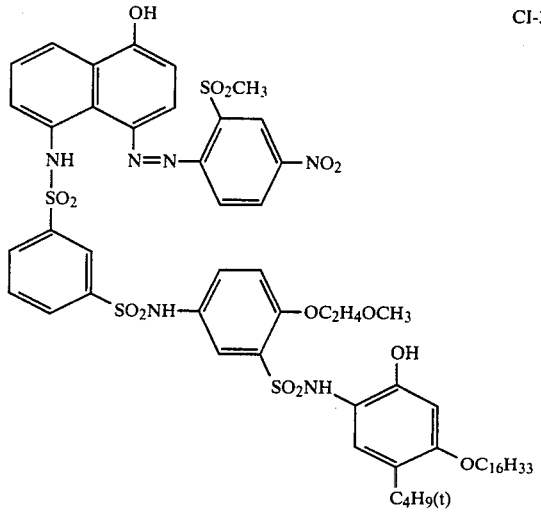
CI-4
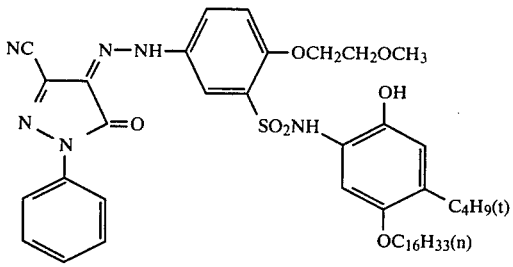
CI-5
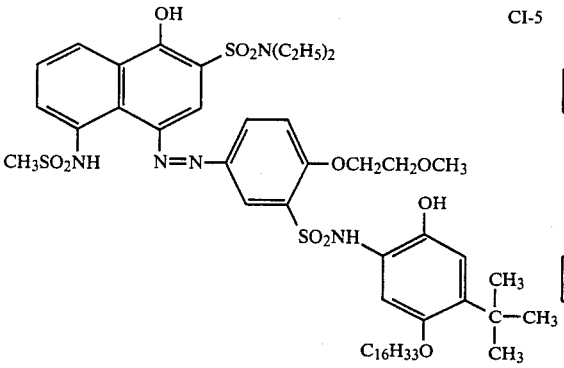
CI-6
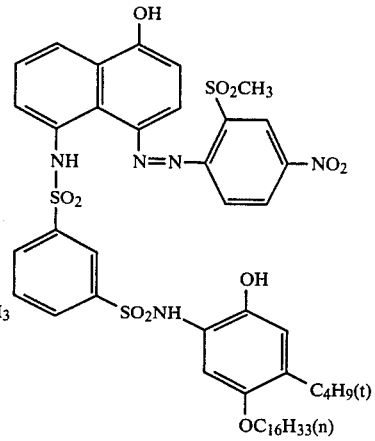
CI-7
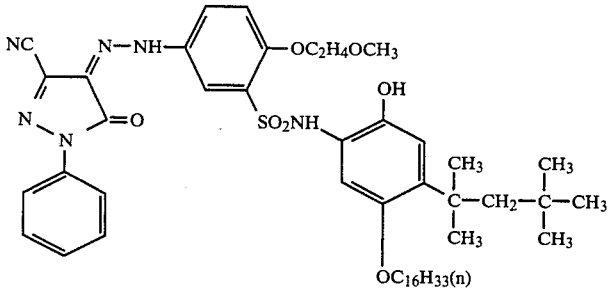
IC-8
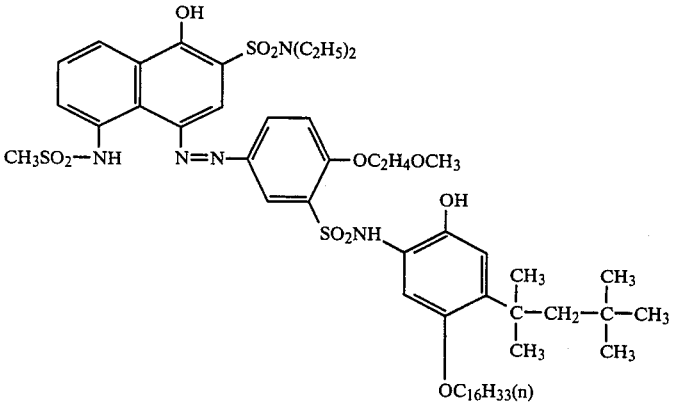

-continued
CI-9
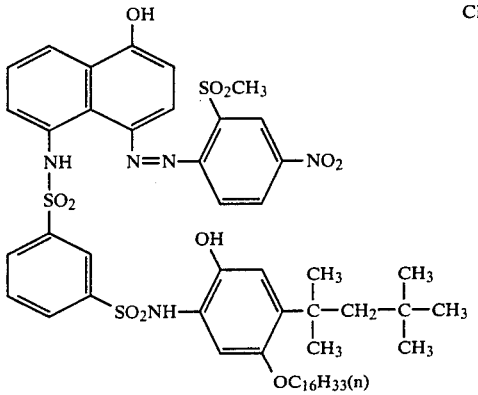
CI-10
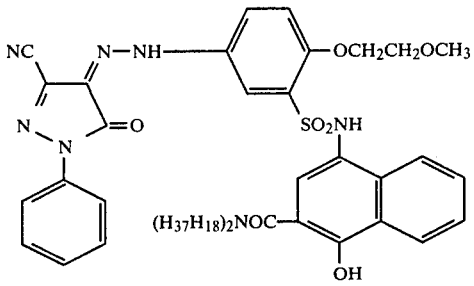
CI-11
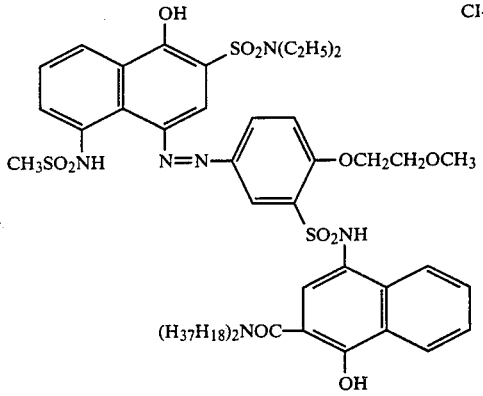
CI-12
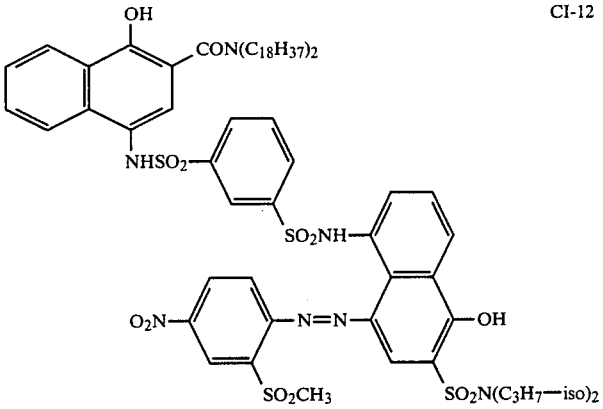
CI-13
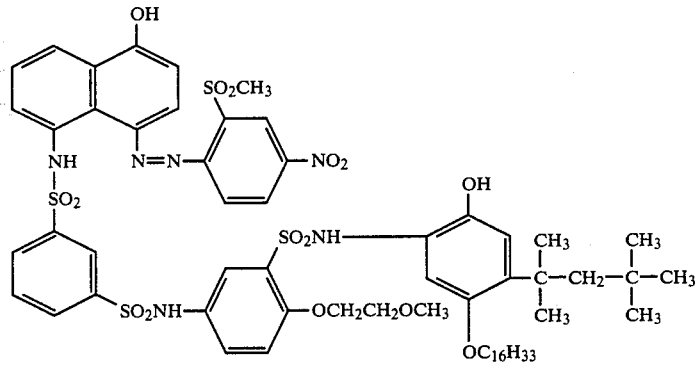
CI-14
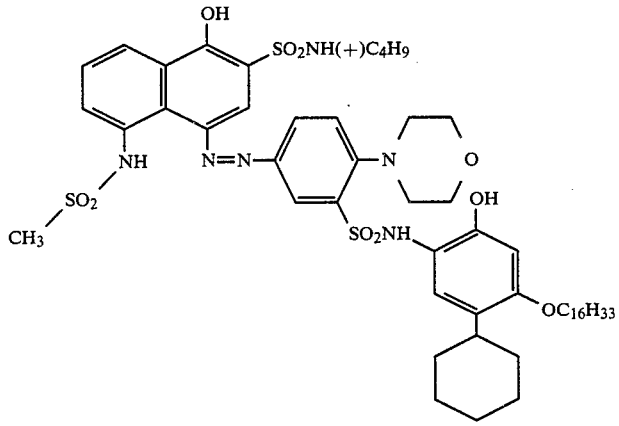

-continued

CI-15

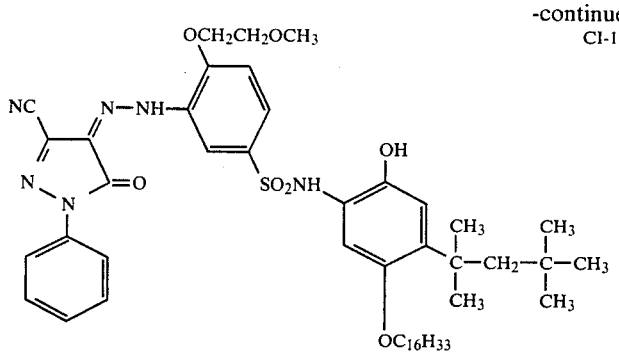

CI-16

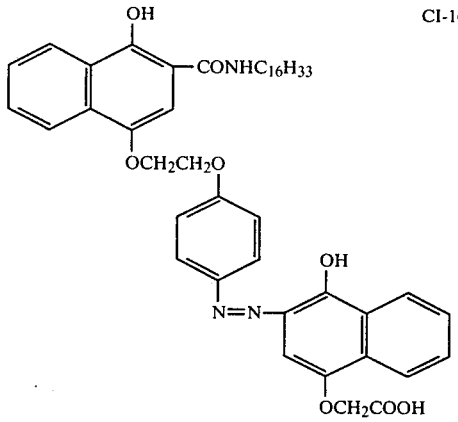

The above described compounds are only given as examples and the present invention should not be construed as being limited thereto.

Many of the above described substances form an imagewise distribution of mobile dyes corresponding to exposure in a light-sensitive material by heat development, and methods for transferring these images dyes into a dye fixing material (so-called diffusion transfer) to produce images are described in the above described patents and Japanese Patent Application (OPI) Nos. 168439/84 and 182447/84.

The dye providing substance used in the present invention can be introduced into a layer of the light-sensitive material by known methods such as the method as described in U.S. Pat. No. 2,322,027, such as by using an organic solvent having a high boiling point or an organic solvent having a low boiling point as described in the Examples.

For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used. An amount of high boiling point organic solvent used in the present invention is 10 g or less, and preferably 5 g or less, per gram of the dye providing substance.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention various dye releasing activators can be used. These dye releasing activators of the present invention are compounds which are basic and are capable of accelerating development, or so-called nucleophilic compounds. Namely, bases or base precursors are used.

Although base precursors of the present invention can be used as a dye releasing activator, other bases or base precursors can also be incorporated.

The dye releasing activator can be incorporated in the light-sensitive material or a dye fixing material. In the case that the dye releasing activator is incorporated in the light-sensitive material, it is advantageous to use a base precursor.

In the present invention various development stopping agents can be used in order to always obtain constant image regardless of any changes of processing temperature and processing time in heat development.

These development stopping agents mean compounds capable of neutralizing a base or capable of reacting with a base to reduce the basicity in layer immediately after completion of appreprate development. In the concrete, acid precursors releasing an acid by heating, or compounds reacting with a base coexisting by heating are used as a development stopping agent. For example, the embodiments of the acid precursor include oxime esters as described in Japanese Patent Application Nos. 216928/83 and 48305/84, and compounds releasing an acid due to Lossen rearrangement as described in Japanese Patent Application No. 85834/84. The compounds reacting with a base by heating are described in Japanese Patent Application No. 85836/84.

When base precursors are used, the most excellent effect of a development stopping agent is obtained. In that case, the mole ratio of a base precursor/an acid precursor is from 1/20 to 20/1, and preferably from 1/5 to 5/1.

The binder which can be used in the present invention can be employed alone or in a combination thereof. A hydrophilic binder can be used as the binder according to the present invention. The typical hydrophilic binder is a transparent or translucent hydrophilic binder, examples of which include a natural substance, for example, protein such as gelatin, a gelatin derivative, etc., a polysaccharide such as starch, gum arabic, a cellulose derivative, etc., and a synthetic polymer, for example, a water-soluble polyvinyl compound such as polyvinyl alcohol, polyvinylpyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trichloroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

Furthermore, it is also preferred to use azolthioether and blocked azoline thione compound as described in Belgian Patent No. 768,071, 4-aryl-1-carbamyl-2-tetrazoline-5-thione compound as described in U.S. Pat. No. 3,893,859, and compounds as described in U.S. Pat. Nos. 3,839,041, 3,844,788 and 3,877,940.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include sunlight, flash lamp, strobo light, tungsten lamps, mercury lamps, halogen lamps such as iodine lamps, xenon lamps, laser light sources, CRT light sources, plasma light sources, fluorescent tubes and light emitting diodes, etc.

In the present invention, after the heat developable color photographic material is exposed to light, the resulting latent image can be developed by heating the whole material to a suitably elevated temperature.

As the heating means, a simple heat plate, iron, heat roller, heat generator utilizing carbon or titanium white, etc., or analogues thereof may be used.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layer thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, antihalation and anti-irradiation dyes, hardeners, mordants and so on, are those described in U.S. Pat. Nos. 4,500,626, 4,478,927, 4,463,079, and Japanese Patent Application Nos. 28928/83 (corresponding to U.S. patent application Ser. No. 582,655, filed on Feb. 23, 1984) and U.S. Pat. No. 4,503,137. Methods for the exposure and so on cited in the above described patents can be employed in the present invention also.

The heat-developable photosensitive material of the present invention contains as a base precursor a compound of the general formula (I) or (II) and thus can provide high density images in a short period of time. Furthermore, the heat-developable photosensitive material of the invention shows little change in photographic properties with time, thus providing excellent shelf stability.

This invention is further illustrated by reference to the following examples:

EXAMPLE 1

Preparation of Silver Iodide-Bromide Emulsion 40 g of gelatin and 26 g of KBr were dissolved in 3,000 ml of water. The solution was stirred while being maintained at a temperature of 50° C.

A solution of 34 g of silver nitrate in 200 ml of water and 200 ml out of a solution of 0.02 g of a dye I described below in 300 ml of methanol were gradually added to the above solution simultaneously over a 10 minute period.

A solution of 3.3 g of KI in 100 ml of water was gradually added to the admixture over a 2 minute period.

The resulting silver iodide-bromide emulsion was adjusted to a proper pH value so that precipitation took place and excess salts were removed therefrom.

Thereafter, the emulsion was adjusted to pH 6.0 to obtain 400 g of a silver iodide-bromide emulsion.

Preparation of Gelatin Dispersion of Coupler 5 g of 2-dodecylcarbamoyl-1-naphthol, 0.5 g of sodium 2-ethylhexyl succinate sulfonate and 2.5 g of tricresyl phosphate (TCP) were weighed out. 30 ml of ethyl acetate was added to the above materials and dissolved. The solution and 100 g of a 10% gelatin solution were mixed with stirring. The mixture was then subjected to homogenization at 10,000 RPM in a homogenizer for 10 minutes to produce a dispersion.

Dye I

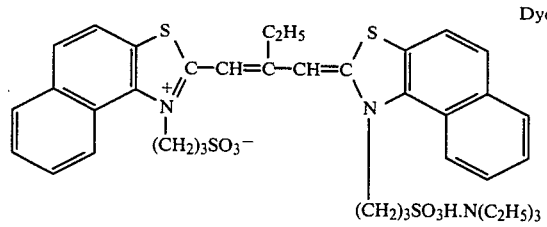

A coating material of the composition listed below was applied on a polyethylene terephthalate support in a wet coating amount of 60 μm thereon, and then allowed to dry to prepare a photosensitive material.

(a) Silver iodide-bromide emulsion: 10 g
(b) Gelatin dispersion of coupler: 3.5 g
(c) Base precursor (12) of the invention: 0.23 g
(d) Gelatin (10% aqueous solution): 5 g
(e) Solution of 0.2 g of 2,6-dichloro-p-aminophenol in 17 ml of water The photosensitive material thus obtained was subjected to imagewise exposure to tungsten light of 2,000 lux for 5 seconds. Thereafter, upon uniformly heating for 20 seconds over a heat block which had been heated to a temperature of 150° C., the photosensitive material provided a negative cyan image. The density of the image measured using a Macbeth penetration densitometer (TD-504) was a minimum density (D min.) of 0.20 and a maximum density (D max.) of 1.98.

The above results show that the compound of the invention provides a high density image.

EXAMPLE 2

In this example the same type of silver iodidebromide emulsion as used in Example 1 was used and the following dispersion of dye providing substance:

Preparation of Dispersion of Dye Providing Substance 5 g of the above dye providing substance CI-2, 0.5 g of sodium 2-ethylhexyl succinate sulfonate as a surface active agent, 5 g of tricresyl phosphate (TCP) were weighed out. 30 ml of ethyl acetate was added to the materials thus weighed out. The admixture was then heated to a temperature of about 60° C. so that the materials dissolved. The solution and 100 g of a 10% gelatin solution were mixed together with stirring. The mixture was then subjected to homogenization at 10,000 RPM in a homogenizer for 10 minutes to produce a dispersion.

A photosensitive coating material was prepared as described below:

(a) Photosensitive silver iodide-bromide emulsion (as described in Example 1): 25 g (b) Dispersion of the above dye providing substance CI-2: 33 g (c) 5% Aqueous solution of a compound of the formula shown below: 10 ml

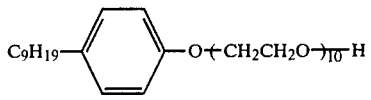

(d) 10% Aqueous solution of a compound of the formula shown below: 4 ml $H_2NSO_2N(CH_3)_2$ (e) Base precursor (12) of the invention: 2.2 g (f) Water: 20 ml The above materials (a) to (f) were mixed and heated so that the solid materials dissolved. The solution thus prepared was applied on a polyethylene terephthalate film in a wet thickness of 30 μm.

After being allowed to dry, the sample thus coated was subjected to imagewise exposure to tungsten light of 2,000 lux for 10 seconds. Thereafter, the sample thus exposed was uniformly heated for 20 seconds on a heat block which had been heated to a temperature of 150° C. This sample was designated Sample A.

Samples B, C and D were prepared as for Sample A except that the component (e), i.e. base precursor (12) of the invention was replaced by 1.8 g of guanidine trichloroacetic acid, 2.1 g of guanidine phenylsulfonylacetate, and 2.2 g of 3-guanidine sulfamoylphenylsulfonylacetate, respectively.

An image receiving material having an image receiving layer was prepared as described below.

10 g of poly(methyl acrylate-co-N,N,N-trimethyl-N-vinylbenzylammonium chloride) molar proportion of methyl acrylate to vinylbenzylammonium: 1:1) was dissolved in 200 ml of water. The aqueous solution was uniformly mixed with 100 g of 10% lime-treated gelatin. The mixed solution was uniformly applied on a paper support laminated with a polyethylene having titanium dioxide dispersed therein in a wet thickness of 90 μm. The sample was allowed to dry for use as an image receiving material.

After being immersed in water, the image receiving materials thus prepared was laminated with the above heated photosensitive materials Samples A, B, C, and D, respectively, so that the respective coated film surfaces were brought into contact with each other.

After these laminates were heated for 6 seconds over a heat block at 80° C., the image receiving materials were peeled from the photosensitive materials. As a result, negative magenta images were formed on the image receiving materials. These negative images were measured using a Macbeth reflection densitometer (RD-519) for maximum density (D max.) and minimum density (D min.).

Furthermore, after being stored at a temperature of 60° C. for 2 days, Samples A, B, C and D were subjected to the same procedures as described above, and then the maximum density (D' max.) and the maintain density (D' min.) were measured.

These results obtained are shown in Table 1 below.

TABLE 1

| Sample No. | D max. | D min. | D' max. | D' min. |
|---|---|---|---|---|
| A (Invention) | 2.05 | 0.22 | 2.02 | 0.28 |
| B (Comparative) | 2.14 | 0.58 | Foggy all over the surface | Foggy all over the surface |
| C (Comparative) | 1.28 | 0.16 | 1.33 | 0.20 |
| D (Comparative) | 1.45 | 1.15 | 1.49 | 0.27 |

The results in Table 1 above show that the base precursor of the present invention provides a high maximum image density and a low minimum image density and the photosensitive materials have a stable shelf life.

EXAMPLE 3

The procedures described in Example 2 were repeated except that base precursors shown in Table 2 below were used.

The results obtained are shown in Table 2 below.

TABLE 2

| Sample No. | Base Precursor (added amount) | D max. | D min. | D' max. | D' min. |
|---|---|---|---|---|---|
| E | Compound (13) (2.2 g) | 2.02 | 0.23 | 2.00 | 0.28 |
| F | Compound (15) (2.5 g) | 2.08 | 0.22 | 2.02 | 0.25 |
| G | Compound (20) (2.5 g) | 2.10 | 0.25 | 2.05 | 0.29 |
| H | Compound (27) (1.9 g) | 1.98 | 0.18 | 1.98 | 0.19 |

The results in Table 2 above show that the base precursors of the invention provide a high maximum density and a low minimum density and the photosensitive materials have a stable shelf life.

EXAMPLE 4

The use of an organic silver salt oxidizing agent is described hereinafter.

Preparation of Silver Benzotriazole Emulsion 28 g of gelatin and 13.2 g of benzotriazole were dissolved in 3,000 ml of water. The solution was stirred while maintained at a temperature of 40° C. A solution of 17 g of silver nitrate in 100 ml of water was gradually added to the solution over a 2 minute period.

The resulting silver benzotriazle emulsion was then adjusted to a proper pH so that precipitation took place and excess salts were removed therefrom. Thereafter, the pH of the emulsion was adjusted to 6.0 to obtain silver benzotriazole in a 400 g yield.

Using the resulting silver benzotriazole emulsion, a photosensitive coating material was prepared as follows:

(a) Silver iodide-bromide emulsion (as described in Example 1): 20 g (b) Silver benzotriazole emulsion: 10 g (c) Dispersion of dye providing substance (as described in Example 2): 33 g (d) 5% Aqueous solution of a compound of the formula shown below: 10 ml

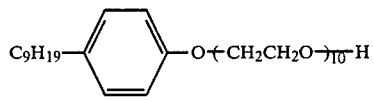

(e) 10% Aqueous solution of a compound of the formula shown below: 4 ml $H_2NSO_2N(CH_3)_2$ (f) Base precursor (12) of the invention: 2.4 g
(g) Gelatin dispersion of acid precursor described below: 8 ml
(h) Water: 12 ml The above gelatin dispersion of acid precursor (g) was prepared as follows:

10 g of a compound of the general formula shown below was added to 100 g of a 1% aqueous solution of gelatin. The mixture was subjected to grinding using 100 g of glass beads of about 0.6 mm average diameter in a mill for 10 minutes. The materials thus ground was filtered to remove the glass beads therefrom so that a gelatin despersion of the acid precursor was obtained.

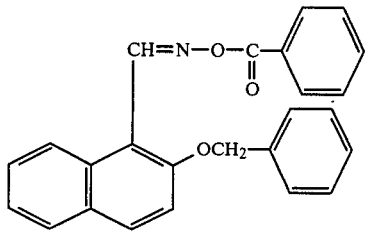

The above materials (a) to (g) were mixed together. Using this mixture, samples were prepared and the procedures used in Example 2 were repeated. The results obtained are whown below.

| | | Maximum density | Maximum density |
|---|---|---|---|
| (A') | Sample containing base precursor (12) of the invention | 2.03 | 0.16 |
| (B') | Sample containing guanidine trichloroacetate (comparative) | 2.33 | 0.61 |
| (C') | Sample containing guanidine phenylsulfonylacetate (comparative) | 1.47 | 0.19 |

The above results show that the base precursor of the invention provides a high maximum density and a low minimum density.

Furthermore, after being stored at a temperature of 60° C. for two days, Samples A', B' and C' were subjected to the same procedures as described above. As a result, Samples A' and C' showed a minimum density of 0.17 and 0.20 and a maximum density of 2.01 and 1.52, respectively. Sample B' showed fog all over the surface thereof. These results show that the sample of the invention has excellent shelf stability.

EXAMPLE 5

Preparation of Silver Benzotriazole Emulsion Containing Photosensitive Silver Bromide 6.5 g of benzotriazole and 10 g of gelatin were dissolved in 1,000 ml of water. The aqueous solution was stirred while being maintained at a temperature of 50° C. A solution of 8.5 g of silver nitrate in 100 ml of water was gradually added to the above aqueous solution over a 2 minute period.

A solution of 1.2 g of potassium bromide in 50 ml of water was gradually added to the mixture over a 2 minute period. The emulsion thus prepared was adjusted to a proper pH so that precipitation took place and excess salts were removed therefrom. Thereafter, the pH of the emulsion was adjusted to 6.0. The yield was 200 g.

Preparation of Gelatin Dispersion of Dye Providing Substance 10 g of a dye providing substance CI-16 of the structural formula shown below, 0.5 g of sodium 2-ethylhexyl succinate sulfonate as a surface-active agent, and 4 g of tricresyl phosphate (TCP) were weighed out.

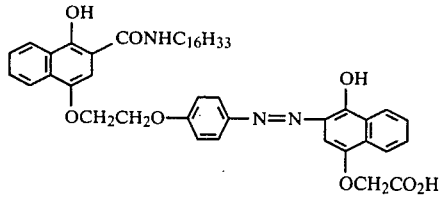

20 ml of cyclohexanone was added to the materials thus weighed out. The mixture was heated to a temperature of about 60° C. to promote dissolution so that a uniform solution was obtained. The solution and 100 g of a 10% solution of lime-treated gelatin were mixed together with stirring. The mixture was then subjected to homogenization at 10,000 rpm for 10 minutes in a homogenizer to achieve dispersion.

A photosensitive coating material was prepared as described hereinafter.

(a) Silver benzotriazole emulsin containing photosensitive silver bromide: 10 g
(b) Dispersion of dye providing substance: 3.5 g
(c) Base precursor (12) of the invention: 0.23 g
(d) Gelatin (10% aqueous solution): 5 g
(e) Solution of 200 ml of 2,6-dichloro-4-aminophenol in 4 ml of methanol The above component (a) to (e) were mixed together and then heated to promote dissolution thereof. The resulting solution was applied on a polyethylene terephthalate film of a thickness of 180 μm in a thickness of 30 μm. After being allowed to dry, the sample thus coated was subjected to imagewise exposure to tungsten light of 2,000 lux for 10 seconds. The sample thus exposed was uniformly heated for 30 seconds over a heat block heated to a temperature of 150° C.

The same image receiving material as described in Example 2 was used. The image receiving material was processed as in Example 2 to develop negative magenta images thereon. The density of the image was measured using a Macbeth reflection densitometer (RD-519) and a maximum density of 2.06 and a minimum density of 0.14 were obtained.

The above results show that the compound of the invention has an excellent effect.

EXAMPLE 6

Preparation of Gelatin Dispersion of Dye Providing Substance CI-17

20 m of cyclohexane was added to a dye providing substance CI-17 of the structural formula:

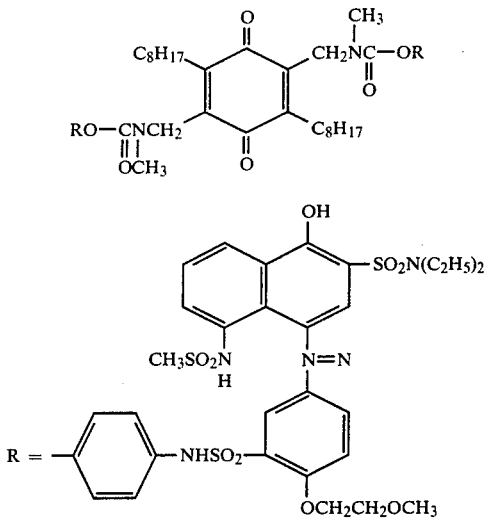

4 g of an electron donor of the structural formula:

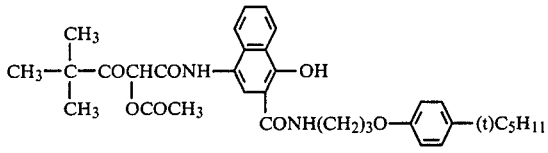

0.5 g of sodium 2-ethylhexyl succinate sulfonate, and 10 g of tricresyl phosphate.

The admixture was heated to a temperature of about 60° C. to promote dissolution. The resulting solution and 100 g of a 10% gelatin solution were mixed together with stirring. The mixture was then homogenized at 10,000 rpm in a homogenizer for 10 minutes to achieve dispersion.

A photosensitive coating material was prepared as described hereinafter.

(a) Silver benzotriazole emulsion containing photosensitive silver bromide (as described in Example 5): 10 g (b) Dispersion of dye providing substance (as prepared in this example): 3.5 g (c) Base precursor (12) of the invention: 0.33 g (d) 5% Aqueous solution of a compound of the formula shown below: 1.5 ml

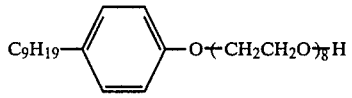

The above component (a) to (d) were admixed with 4 ml of water, and then heated to promote dissolution thereof. The solution thus obtained was applied on a polyethylene terephthalate film in a wet thickness of 30 μm. The material thus coated was allowed to dry to prepare a photosensitive material.

The photosensitive material thus prepared was then subjected to imagewise exposure to tungsten light of 2,000 lux for 10 seconds. The photosensitive materials thus exposed was uniformly heated for 40 seconds over a heat block heated to a temperature of 140° C.

An image receiving material as described in Example 2 was immersed in water, and then laminated with the above heated photosensitive material in such a manner that the respective coated film surfaces were brought into contact with each other. As a result, the image receiving material developed a positive magenta image thereon. The density of the positive image was measured using a Macbeth reflection densitometer (RD-519). The photosensitive material was found to provide a maximum density of 2.01 and a minimum density of 0.17 when measured using green light.

The above results show that the base precursor of the invention is effective.

While the invention has been described in detail and with reference to specific embodiments thereof, it will be apparent to one skilled in the art that various changes and modifications can be made therein without departing from the spirit and scope thereof.

What is claimed is:

1. A heat-developable photosensitive material which comprises a light-sensitive material and a compound as a base precursor of the general formula:

(I)

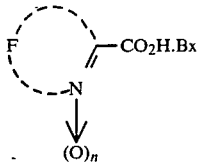

(II)

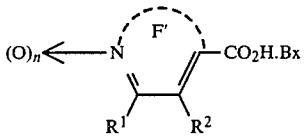

wherein F and F′ each represents an atomic group necessary for the formation of a 5- or 6-membered ring which may have condensed rings therewith; n represents an integer of 0 or 1; $R^1$ and $R^2$, which may be the same or different, each represents a hydrogen atom, a halogen atom, a hydroxyl group, a cyano group, or a substituted or unsubstituted alkyl group, cycloalkyl group, alkenyl group, alkynyl group, aryl group, heterocyclic group, aralkyl group, alkoxy group, aryloxy group, acylamino group, acyloxy group, acyl group, carbamoyl group, sulfamoyl group, sulfamoylamino group, ureido group, alkylsulfonyl group, arylsulfonyl group, alkylsulfonylamino group, arylsulfonylamino group, alkoxycarbonyl group or alkoxycarbonylamino group, —$CO_2H.B$ wherein B is as defined herein or —$CO_2M$; and $R^1$ and $R^2$ may be combined and form a ring, M is an alkali metal or H.Bx in which B represents an organic base; and x represents an integer of 1 when B is a monoacidic base and represents ½ when B is a diacidic base.

2. The heat-developable photosensitive material of claim 1, wherein $R^1$ and $R^2$, which may be the same or different, each represents a hydrogen atom, a halogen atom, a hydroxyl group, a cyano group, a substituted or unsubstituted alkyl group having 1 to 10 carbon atoms, a substituted or unsubstituted cycloalkyl group having 5 to 8 carbon atoms, a substituted or unsubstituted alkenyl group having 2 to 5 carbon atoms, a substituted or unsubstituted alkynyl group having 2 to 5 carbon atoms, a substituted or unsubstituted aryl group having 6 to 18 carbon atoms, a substituted or unsubstituted 5- or 6-membered heterocyclic group, a substituted or unsubstituted aralkyl group having 7 to 15 carbon atoms, or a substituted or unsubstituted alkoxy group having 1 to 10 carbon atoms, a substituted or unsubstituted aryloxy group having 6 to 10 carbon atoms, a substituted or unsubstituted acylamino group having 1 to 10 carbon atoms, a substituted or unsubstituted acyloxy group having 1 to 10 carbon atoms, a substituted or unsubstituted acyl group having 1 to 10 carbon atoms, a substituted or unsubstituted carbamoyl group having 1 to 10 carbon atoms, a substituted or unsubstituted sulfamoyl group having 1 to 10 carbon atoms, a substituted or unsubstituted ureido group having 1 to 10 carbon atoms, a substituted or unsubstituted sulfamoylamino group having 1 to 10 carbon atoms, a substituted or unsubstituted alkylsulfonyl group having 1 to 10 carbon atoms, a substituted or unsubstituted arylsulfonyl group having 6 to 10 carbon atoms, a substituted or unsubstituted alkylsulfonylamino group having 1 to 10 carbon atoms, a substituted or unsubstituted arylsulfonylamino group having 6 to 10 carbon atoms, or a substituted or unsubstituted alkoxycarbonylamino group having 2 to 10 carbon atoms, —$CO_2H.B$ group or —$CO_2M$ group.

3. The heat-developable photosensitive material of claim 2, wherein $R^1$ and $R^2$ each represents a hydrogen atom or combine to form a benzene ring.

4. The heat-developable photosensitive material of claim 1, wherein F represents the atomic group necessary for forming a benzimidazole ring, a benzothiazole ring, a pyridine ring, a pyrazine ring, a pyrimidine ring or a triazine ring and F′ represents the atomic group necessary for formation of a pyrazole ring or a pyridine ring.

5. The heat-developable photosensitive material of claim 1, wherein B represents an organic base having a pKa of 9 or more and a boiling point of about 100° C. or more.

6. The heat-developable photosensitive material of claim 1, wherein B represents a guanidine or an amidine.

7. The heat-developable photosensitive material of claim 1, wherein B is an organic base having 10 or less carbon atoms.

8. The heat-developable photosensitive material of claim 1, wherein B is selected from the group consisting of

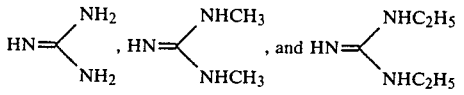

9. The heat-developable photosensitive material of claim 1, wherein said light-sensitive material is a silver halide emulsion.

* * * * *